United States Patent [19]

Marion

[11] Patent Number: 4,506,928

[45] Date of Patent: Mar. 26, 1985

[54] BABY CHAIR

[75] Inventor: Samuel Marion, Mahwah, N.J.

[73] Assignee: Gerber Products Company, Fremont, Mich.

[21] Appl. No.: 474,235

[22] Filed: Mar. 11, 1983

[51] Int. Cl.[3] ..... H47B 39/00

[52] U.S. Cl. ..... 297/174; 297/134

[58] Field of Search ..... 297/174, 134, 256, 254, 297/150; 248/217.1, 217.2, 217.3; 182/58

[56] References Cited

U.S. PATENT DOCUMENTS

| | | | |
|---|---|---|---|
| D. 166,908 | 6/1952 | Ducey | D15/1 |
| D. 181,700 | 12/1957 | Armitage | D15/1 |
| D. 200,850 | 4/1965 | Palmer et al. | D15/1 |
| D. 205,066 | 6/1966 | Barnhill | D15/1 |
| D. 231,588 | 5/1974 | Hanley | D6/1 |
| D. 248,799 | 8/1978 | Adams | D6/9 |
| D. 263,769 | 4/1982 | Euwema et al. | D6/9 |
| 1,159,368 | 11/1915 | Embree | 182/58 |
| 2,104,982 | 1/1938 | Forester | 182/58 |
| 2,126,218 | 8/1938 | Schulz, Jr. | 182/58 |
| 2,451,667 | 10/1948 | Ducey | 155/174 |
| 2,489,084 | 11/1949 | Ducey | 155/174 |
| 2,493,187 | 1/1950 | Ducey | 155/174 |
| 2,533,527 | 12/1950 | Soltis | 297/256 |
| 2,540,672 | 2/1951 | Holmes | 155/174 |
| 2,707,987 | 5/1955 | Gibson | 155/174 |
| 2,710,643 | 6/1955 | Wincey et al. | 155/174 |
| 2,974,718 | 3/1961 | Lawrence et al. | 297/256 |
| 3,052,500 | 9/1962 | Hyde | 297/130 |
| 3,059,965 | 10/1962 | Fornetti | 297/174 |
| 3,126,226 | 3/1964 | Johnson | 297/174 |
| 3,133,760 | 5/1964 | Robinson | 297/174 |
| 3,133,761 | 5/1964 | Ross | 297/174 |
| 3,190,691 | 6/1965 | Desjardins | 297/174 |
| 3,213,467 | 10/1965 | Hubbard | 297/150 X |
| 3,243,229 | 3/1966 | Barnhill | 297/134 |
| 3,397,010 | 8/1968 | Leimbruber | 297/174 |
| 4,230,362 | 10/1980 | Euwema et al. | 297/174 |
| 4,248,478 | 2/1981 | Aron | 297/174 |
| 4,312,535 | 1/1982 | Smith | 297/134 X |
| 4,322,110 | 3/1982 | Simmons et al. | 297/174 |

FOREIGN PATENT DOCUMENTS

| | | | |
|---|---|---|---|
| 957265 | 11/1974 | Canada | 297/174 |

*Primary Examiner*—James T. McCall

*Attorney, Agent, or Firm*—Townsend and Townsend

[57] ABSTRACT

A portable baby chair 10 suspendable from the edge of an ordinary table 100 and which has spring biased pivoted locking bars 54, 56 on the chair's under table supports 20, 22 to engage the underside 99 of the table top and prevent the chair from slipping.

21 Claims, 5 Drawing Figures

BABY CHAIR

BACKGROUND OF THE INVENTION

1. Field of the Invention

This invention relates to baby chairs which are suspendable from a table edge, and which can be removed and folded when not in use.

2. Prior Art

Portable baby chairs which can be attached to the edge of an ordinary table are well known. A variety of designs have been proposed for such chairs, and features which have proved advantageous include a cantilever arrangement for holding the chair to the table, a rigid seat bottom and back for greater chair strength, and foldability when the chair is not in use. Chairs embodying these features are described in U.S. Pat. No. 2,707,987 to Gibson, U.S. Pat. No. 3,052,500 to Hyde, U.S. Pat. No. 3,059,965 to Fornetti, U.S. Pat. No. 3,133,760 to Robinson, and U.S. Pat. No. Des. 200,850 to Palmer. Although the cantilever design allows the chairs to be conveniently hooked onto and unhooked from a table edge, it suffers from depending on a child's weight to create the friction needed to hold the chair stable against the table. If the child does not sit still, the chair can work its way back until one or both arm rests slip from the table, endangering the child. Thus, there is a need for a portable baby chair which can be better secured to a table top.

SUMMARY OF THE INVENTION

It is therefore the primary object of this invention to provide a portable baby chair which can be more reliably secured to a table top than could previously known cantilever style chairs. Another object is to provide a strong and stable chair which is convenient to use. This invention achieves these objects by providing a baby chair with a spring biased locking bar on each of the chair's under-table supports. The locking bars are pivoted at their lower ends to the supports. As the unfolded chair is slipped around the edge of a table top with the arm rests above and the supports below, the table top edge causes the bars to rotate backward against the spring force. The top ends of the bars, urged by their springs against the undersurface of the table, follow the pivoted bottom ends of the bars as the supports are swung under the table. Thus, the bars do not hinder hanging the chair from a table. However, once the chair is in place, pushing the chair away from the table causes the tops of the locking bars to dig in to the undersurface of the table and to hold the chair stationary. The locking bars are covered by gripping material for a better hold. When desired, the chair is easily removed from the table by grasping each of the bars and pulling it down from the table undersurface.

DETAILED DESCRIPTION OF THE PREFERRED EMBODIMENT

Figure 1:
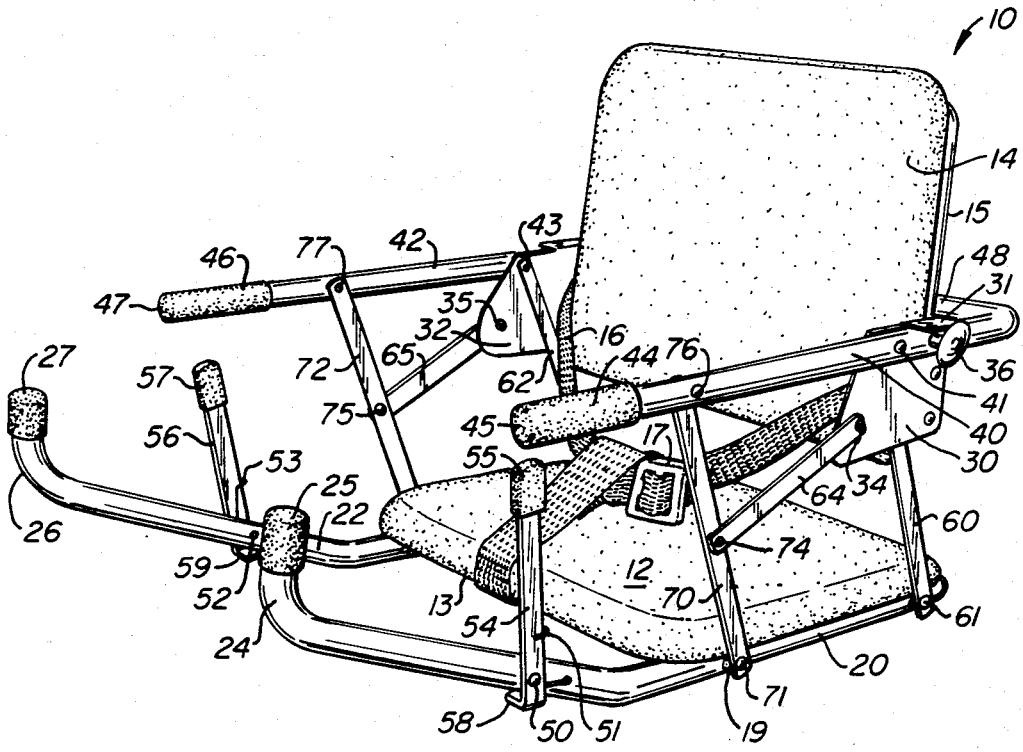
FIG. 1 is a perspective view of the chair.
Figure 2:
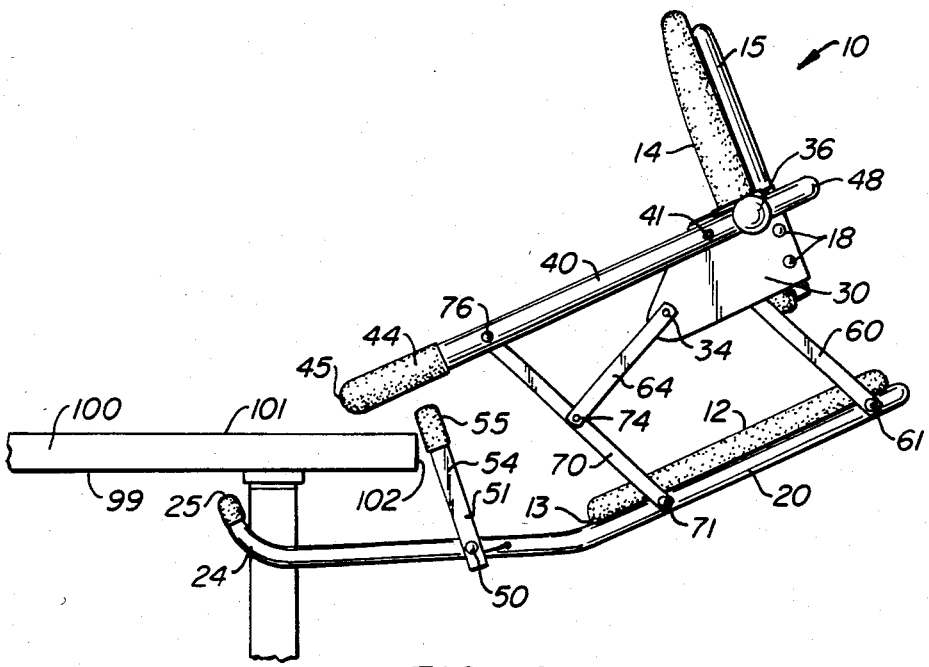
FIG. 2 is a side elevation of the chair showing how it is slipped around a table edge.

Referring to FIGS. 1 and 2, the baby chair 10 may be suspended from the edge of an ordinary table 100. Chair 10 comprises a rigid seat bottom 12 and a rigid seat back 14, both made of suitable material such as plywood and foam padding covered with wipe-clean plastic. A safety harness 16 made, for example, of nylon webbing with a buckle 17 insures that a child does not slip out of the chair, which is normally suspended several feet above a floor on the edge of table 100. Aside from seat bottom 12, back 14, harness 16, table grips 25, 27, 45, 47, 55, and 57, and pivot spacers 19, the rest of the chair is made of metal. A pair of under-table supports 20 and 22 extend from respective rear corners, along the sides, and past the front corners, of seat bottom 12, and turn upward to end in vertical table-abutting sections 24 and 26. Seat bottom 12 is fixedly attached to and supported by supports 20 and 22. Making supports 20 and 22 from a continuous piece of tubular metal including section 21 (FIG. 4) around the back increases the chair's strength and, in particular, helps keep it from twisting or tilting sideways.

A pair of plates 30 and 32 are fixed by rivets, for example, to seat back 14, and each extends forward in a vertical plane parallel to the sides of the chair. A U-shaped seat back reinforcement 15 (FIGS. 2 and 4) may be provided to strengthen the chair, in which case plates 30 and 32 are preferably attached to seat back 14 by way of rivets 18 through reinforcement 15.

Figure 4:
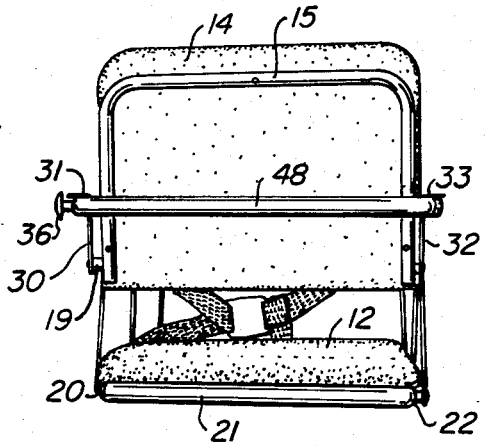
FIG. 4 is a rear elevation of the chair.

A pair of arm rests 40 and 42 rotate relative to plates 30 and 32 by way of plate pivots 41 and 43 respectively. Arm rests 40 and 42 extend forwardly parallel to the side edges and past the front edge 13 of seat bottom 12 to end in table tangent sections 44 and 46. The arm rests 40 and 42 may also be connected in a continuous piece including section 48 as shown in FIG. 4.

Figure 5:
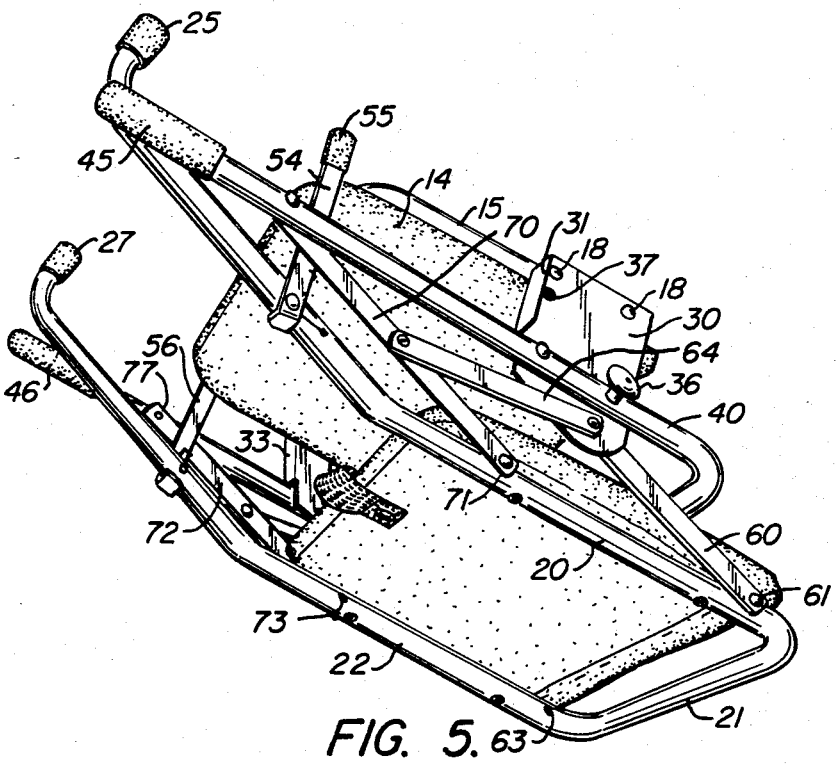
FIG. 5 is a perspective view showing the chair folded for storage.

Supports 20 and 22 are suspended from arm rests 40 and 42, respectively, by a back pair of vertical links 60 and 62 and by a front pair of vertical links 70 and 72, respectively. The links are connected to the arm rests by pivots 41, 43, 76 and 77, and to the supports by pivots 61, 63, 71 and 73. The pivot connections allow the chair to be folded for storage as in FIG. 5 with the arm rest 40, support 20, and links 60 and 70 (and of course the corresponding members on the hidden side) forming a parallelogram, and to be unfolded for use as in FIG. 1 with the named members more rectangularly disposed.

Diagonal links 64 and 65 help to reinforce chair 10 from being deformed by a child's weight, but otherwise do not constrain the chair's folding action. Rather, diagonal links 64 and 65 couple the tilt of seat back 14 to the shape of the parallelogram structure defined by front links 70, 72, rear links 60, 62, arms rests 40, 42 and under table supports 20, 22. Thus, as seat back 14 is moved towards or away from seat 60, 62, 70, 72 and supports 20, 22 to pivot corresponding amounts. See FIGS. 2 and 5. Diagonal link 64 is connected to plate 30 and to link 70 by pivots 34 and 74 respectively, and likewise diagonal link 65 is connected to plate 32 and to link 72 by pivots 35 and 75 respectively.

As shown in FIG. 2, chair 10 is unfolded for use and slipped around the edge of a table 100. Any ordinary table less than 2" thick can be used without modification, although there must be adequate clearance for the child's legs between the seat front edge 13 and the lower corner and any panel (not shown) on table edge 102. A glass topped or otherwise fragile table may not be strong enough, and a pedestal table might tip over. The chair is suspended by cantilever action when a child's weight pulls the arm rest tangent sections 44 and 46 down on points near the edge 102 of table top 101, and the table-abutting sections 24 and 26 of the support bars bear upward on the underside 99 of the table at points further from table edge 102 than the points reached by arm rest sections 44 and 46.

Figure 3:
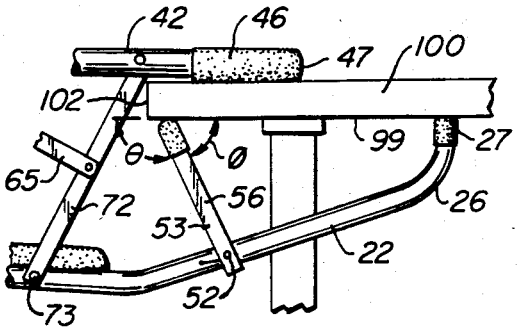
FIG. 3 is a side elevation detail of one of the locking bars.

Locking bars 54 and 56 are attached to supports 20 and 22 by pivots 50 and 52 respectively. Bars 54 and 56 pivot within the limits imposed by bar angles 58 and 59. Biasing springs 51 and 53 urge the bars towards the table abutting ends 24 and 26 of the supports. When the seat is being installed on a table top 100, table edge 102 pushes locking bars 54 and 56 against springs 51 and 53. Obtuse angle theta (FIG. 3) allows the bars to slide by the under surface 99 of the table. However, once the chair is in place, springs 51 and 53 maintain the locking bars against the table, and pushing or pulling chair 10 away from table 100 causes the locking bars 54 and 56 to dig in to the table underside 99 at acute angle phi.

To help keep chair 10 stationary relative to table 100, while protecting table surfaces from being scratched, non-abrasive frictional coverings such as plastic cups 25 and 27, 45 and 47, and 55 and 57 are provided respectively for the ends of table abutting sections 24 and 26, arm rest tangent sections 44 and 46, and locking bars 54 and 56.

When a chair 100 is in use, the child's weight keeps the chair unfolded to the limit imposed by arm rest stops 31 and 33, which are part of, and at right angles to the rest of, plates 30 and 32 respectively. A safety pin 36, shown locked in FIG. 1 and unlocked in FIG. 5, insures that the chair is locked open. Safety pin 36 has a pull knob from which a shaft extends through a hole in arm rest 40 and into a hole 37 in plate 30. A spring (not shown) inside the arm rest holds the pin in plate hole 37 until the shaft is retracted by pulling the knob.

Details have been disclosed to illustrate the invention in a preferred embodiment of which adaptions and modifications within the spirit and scope of the invention will occur to those skilled in the art. The scope of the invention is limited only by the following claims.

What is claimed is:

1. A baby chair of the type which is suspendable from the edge of a table, which has a seat bottom and a seat back, the seat bottom having a front edge, side edges and a back edge, the side edges intersecting the back edge at back corners and intersecting the front edge at front corners, the chair being foldable for storage, comprising:

a pair of under-table supports, each extending from a respective back corner, parallel to the side edges, and past the front edge of said seat bottom, and being turned upward to a vertical table-abutting end;

a pair of plates, each fixed to the seat back and extending forward in a plane parallel to the sides of the chair;

a pair of arm rests, each rest being pivotally attached by a plate pivot to one of said plates and extending forward parallel to the sides and past the front edge of the seat bottom and having a table-tangent end;

a back pair of vertical links, the upper end of each link pivoted on one of the plate pivots, and the lower end pivoted to one of the supports near a back corner of the seat bottom;

a front pair of vertical links, the upper end of each link pivioted on one of the arm rests and the lower end pivoted to one of the supports near a front corner of the seat bottom;

a pair of locking bars, each having a lower end pivoted to a respective one of said supports between the front link and the table-abutting end, the bars extending beyond a plane which is parallel to the seat bottom and which includes the abutting ends; and biasing means at the lower end of each said locking bar to bias the bar in rotation towards the respective table abutting end.

2. A chair as in claim 1 wherein each said plate has a top edge turned perpendicularly outward from the seat back to form an arm rest stop.

3. A chair as in claim 2 wherein at least one of the arm rests has safety pin means for latching the arm rest to the plate.

4. A chair in claim 3 wherein there is a hold through the arm rest and the safety pin means includes a pin having a head with a larger diameter than the hole, and a shaft extending through and beyond the hole, and biasing means to urge said shaft towards said plate, and wherein said plate has curb means to prevent the plate from sliding relative to the shaft until the pin head is pulled to overcome the biasing means and to retract the shaft from the plate.

5. A chair as in claim 1 further including a pair of diagonal links, each diagonal link having a first end pivotally connected to a respective one of said plates and a second end pivotally connected mid-way between the ends of a respective one of said front links, said diagonal links coupling said front pair of vertical links to the seat back so movement of said seat back relative to said under-table supports causes corresponding pivotal movement of said arm rests relative to said under-table supports.

6. A chair as in claim 1 wherein said table abutting ends, said tangent ends, and said locking bars each have table touching ends covered with non-abrasive gripping material.

7. A chair as in claim 1 wherein said pair of under-table supports are connected in one continuous piece around the back edge of the seat bottom.

8. A chair as in claim 1 wherein said arm rests are connected in one continuous piece around the seat back.

9. A chair as in claim 1 wherein said seat back has a reinforcement, and wherein said plates are attached to the seat back through the reinforcement.

10. A chair as in claim 1 further comprising a safety harness engaging the seat back and having a buckle whereby the harness may be fastened to hold a child in the chair.

11. A chair as in claim 1 made of metal and plastic except for the seat bottom and seat back.

12. In a baby chair having arm rests for engaging the upper surface of a table top, a seat bottom and under table supports for engaging the lower surface of the table top at support ends thereof for suspending the chair from the edge of the table top, the improvement comprising:

a pair of locking bars, each having a lower end pivoted to a respective one of the supports and extending upward beyond a plane which is parallel to the seat bottom and which includes the ends of the supports.

13. The baby chair of claim 12 further comprising biasing means at the lower end of each locking bar to bias the bar in rotation upwardly towards the table top lower surface and outwardly towards the respective support end.

14. A baby chair of the type for mounting to the edge of a table top, the table top having upper and lower surfaces, comprising:

a chair structure including a seat and a seat back attached to the seat;

an arm attached to and extending from the chair structure and having portions configured to engage the upper table top surface;

an under-table support attached to and extending from the chair structure and having an outer part configured to engage the lower table top surface; and a locking bar pivotally mounted to said under-table support and having a distal end for engaging the lower table top surface at an acute angle to the vertical to secure the baby chair to the table top.

15. The baby chair of claim 14 further comprising means for biasing said locking bar to pivot said distal end upwardly toward the table top lower surface and outwardly away from said chair structure, so said distal end of said locking bar engages the table top lower surface.

16. The baby chair of claim 14 further comprising first and second arms.

17. The baby chair of claim 16 wherein said first and second arms generally overlie first and second under-table supports.

18. The baby chair of claim 17 including first and second locking bars mounted to respective first and second under-table supports.

19. The baby chair of claim 14 wherein said table top surface engaging portions are horizontally positioned between said outer part of said under-table support and said locking bar distal end when the baby chair is mounted to the table top.

20. A baby chair of the type for mounting to the edge of a table top having upper and lower surfaces, comprising:

a chair structure;

a first arm attached to and extending from said chair structure for engagement of said upper surface;

a second arm attached to and extending from said chair structure for the engagement of said lower surface; and locking means pivotally mounted to said second arm for further engagement of said lower surface to ensure the maintenance of the baby chair to the table top.

21. A baby chair in accordance with claim 20 and further characterized by said chair structure including a seat and a seat back attached to the seat, said first arm being secured to said seat back and said second arm being secured to said seat.

* * * * *